United States Patent [19]

Singheiser et al.

[11] Patent Number: 4,909,984

[45] Date of Patent: Mar. 20, 1990

[54] HIGH TEMPERATURE PROTECTIVE COATING

[75] Inventors: Lorenz Singheiser, Heidelberg; Georg Wahl, Eppelheim; Bernd Jahnke, Neckargemund, all of Fed. Rep. of Germany

[73] Assignee: BBC Aktiengesellschaft Brown, Boveri & Cie, Baden, Switzerland

[21] Appl. No.: 291,355

[22] Filed: Dec. 29, 1988

Related U.S. Application Data

[63] Continuation of Ser. No. 37,617, Apr. 13, 1987, abandoned.

[30] Foreign Application Priority Data

Apr. 15, 1986 [DE] Fed. Rep. of Germany ..... 3612568

[51] Int. Cl.[4] ..... C22C 19/05

[52] U.S. Cl. ..... 420/443; 420/445; 428/679; 428/680

[58] Field of Search ..... 420/443, 445; 148/410, 148/428; 428/678, 679, 680

[56] References Cited

U.S. PATENT DOCUMENTS 4,034,142 7/1977 Hecht ..... 428/678

4,312,682 1/1982 Herchenroeder ..... 420/443

*Primary Examiner*—R. Dean

*Attorney, Agent, or Firm*—Herbert L. Lerner; Laurence A. Greenberg

[57] ABSTRACT

A high temperature protective coating formed by an alloy on the basis of nickel, cobalt, chromium, aluminum and also frequently of yttrium. There is improved adherence of the metallic oxide covering layer which forms on the protective coating and increased the oxidation and corrosion resistance. Silicon may be admixed to the alloy as a first addition. The amount of the silicon to be admixed to the alloy lies between 1 and 3% by weight. The oxidation and corrosion resistance can be increased by means of a further addition of zirconium in an amount of 1% by weight. The same results can be obtained by a further addition of tantalum, also in the amount of 1% by weight.

4 Claims, 5 Drawing Sheets

11
36
FEEDER
15
38
SINGULATOR
17
38
SEALER
DIVERTER
40
SEALER
21
TRANSPORT
19
38
SYSTEM CONTROLLER
13
INTEGRATED MOD.
23
SCALE MOD.
25
METER MOD.
27
INKER MOD.
29
TAPE MOD.
31
TRANSPORT MOD.
33
PLATEN MOD.
35
38

MMP MOTOR CONTROLLER SOFTWARE HIERARCHY

HIGH TEMPERATURE PROTECTIVE COATING

This application is a continuation, of application Ser. No. 037,617filed Apr. 13, 1987, now abandoned.

BACKGROUND OF THE INVENTION

1. Field of the Invention

The invention relates to a high temperature protective coating made from an alloy containing nickel, cobalt, chromium, aluminum and also yttrium, especially for structural elements of an austenitic material.

2. Description of the Prior Art

Such high temperature protective coatings are used especially when the basic material of structural parts made of heat resistant steel and/or alloys used at temperatures above 600° C must be protected.

By use of these high temperature protective coatings it is intended to slow or completely stop the effects of high temperature corrosion, caused especially by sulfur, oil residue, oxygen, alkaline earths and vanadium. Such high temperature protective coatings are prepared such that they can be applied directly to the basic material of the structural element to be protected.

High temperature protective coatings are of special importance with structural elements of gas turbines. They are mainly applied to rotors and guide vanes as well as heat accumulation segments of gas turbines.

To manufacture these structural elements, an austenitic material on the base of nickel, cobalt or iron is preferably used. Nickel super alloys are mainly used as basic material in the manufacture of structural parts of gas turbines.

Structural parts intended for gas turbines are, for example, provided with protective coatings made by an alloy containing nickel, cobalt, chromium, aluminum and yttrium.

The aluminum content of these alloys is relative high, while the chromium content is very low, which leads to a low corrosion resistance. This is due to the low chromium content.

Protective coatings made of the alloys mentioned above have a tendency to form a covering layer containing aluminum oxide on their surfaces under operational condition, especially if exposed to temperatures of more than 900° C. Because of the yttrium contained in the alloy, a certain adherence of the aluminum oxide covering layer to the protective coating occurs.

The structure of these protective coatings consists of a matrix into which an aluminum-containing phase has been inserted. Quick aluminum depletion of the areas near the surface results because of continuous oxidation. This leads to an increased susceptibility to corrosion of the protective coatings.

As another disadvantage it must be emphasized that these protective coatings are not sufficiently adapted to the basic material of the structural elements to be protected. Especially at high temperatures adherence is not sufficient.

SUMMARY OF THE INVENTION

It is an object of the invention to provide a high temperature protective coating having a low oxidation rate which is corrosion resistant and additionally can be adapted to the basic materials of the structural elements even at high temperatures.

With the foregoing and other objects in view, there is provided in accordance with the invention a high temperature protective coating made from an alloy containing nickel, cobalt, chromium, aluminum and yttrium, especially for structural elements of an austenitic material, and to which alloy at least one metal-like element of the fourth main group of the Periodic Table of the Elements is admixed as a first addition.

In accordance with the invention, there is provided a high temperature protective coating of an alloy, especially for structural elements made from an austenitic material, containing 18 to 27% by weight of chromium, 8 to 12% by weight of aluminum, 0.5 to 3% by weight of silicon, 1% by weight of zirconium and 5 to 20% by weight of cobalt in relation to the total weight of the alloy and the remainder of the alloy is nickel.

Other features which are considered as characteristic for the invention are set forth in the appended claims.

Although the invention is illustrated and described herein as embodied in high temperature protective coating, it is nevertheless not intended to be limited to the details shown, since various modifications may be made therein without departing from the spirit of the invention and within the scope and range of equivalents of the claims.

The invention, however, together with additional objects and advantages thereof will be best understood from the following description.

DESCRIPTION OF THE PREFERRED EMBODIMENTS

Figure 1:
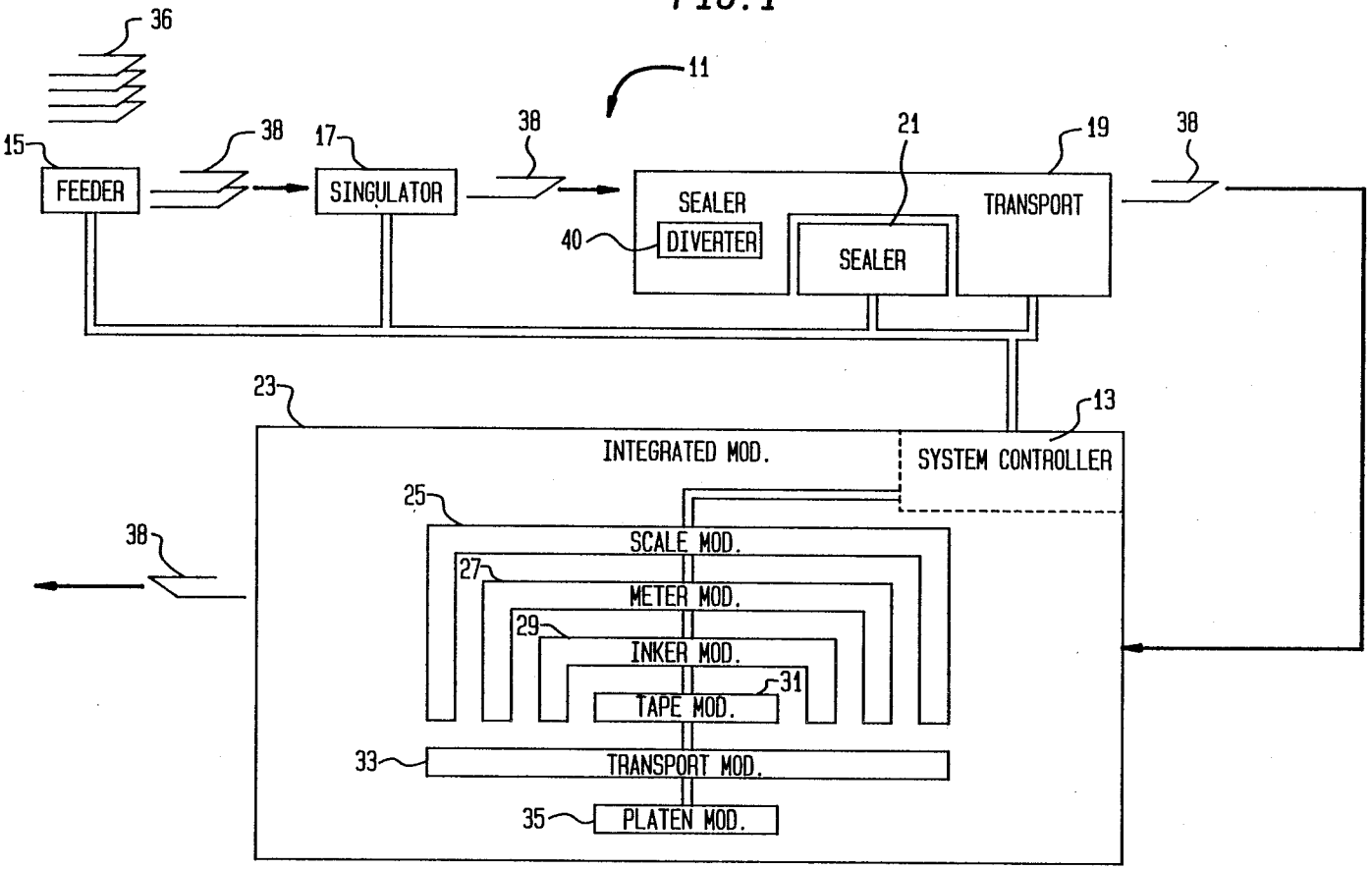

The adherence of the metallic oxide coating being formed, especially of the aluminum oxide covering layer being formed, is increased in accordance with the invention by the addition of silicon and hereby the corrosion resistance of the high temperature protective coating is considerably increased. By the addition of zirconium and silicon to such an alloy the oxidation and corrosion resistance is increased and the chromium content can be kept very high. The amount of zirconium added to the alloy is 0.2 to 2% by weight, preferably 1% by weight, in relation to the total weight of the alloy. The low solubility of zirconium in a nickel-based alloy leads to the precipitation of phases rich in zirconium. Such an alloy can, if required, by used with a very small amount of yttrium, for example 0.1 to 1% by weight in relation to the total weight of the alloy, or even without yttrium.

By the addition of tantalum to the alloy forming the high temperature protective coating its oxidation resistance is increased, the adhesion of the oxide layer improved and thus the corrosion resistance increased. The tantalum supplied to the alloy is contained in the matrix in solution. 0.5 to 3, preferably 1%, by weight of tantalum is added to the alloy. When adding tantalum, the addition of silicon may be omitted, if desired. However, in any case, corrosion resistant protective coatings are obtained especially easily when silicon is added to the alloy in addition to tantalum. If required, small amounts of titanium can be mixed with the alloy. The amount should, however, only be between 0.1 to 2% by weight in relation to the total weight of the alloy. The addition of silicon, silicon and zirconium or silicon and tantalum make it possible for the alloy to have a very large content of chromium, aluminum and cobalt. In the alloy according to the invention the chromium content can be between 18 and 27% by weight, the cobalt content up to 20% by weight and the aluminum content up to 12% by weight in relation to the total weight of the alloy. The amounts of chromium, aluminum and cobalt can also be less. This makes possible a very good adaptation to the nickel-containing basic material of the structural elements. The same also applies to alloys hardened by oxide dispersion, from which are also manufactured many structural elements needing to be protected. Compatibility of the protective coating with these alloys is also present at very high temperatures. Above all, by correctly choosing the amounts of chromium, aluminum and cobalt the interdiffusion effects and the change in the properties of the material which occur at very high temperatures, especially above 950° C., can be clearly reduced or even completely eliminated. An especially advantageous high temperature protective coating having a very good oxidation and corrosion resistance is formed by an alloy having 18 to 25% by weight of chromium, 7 to 12% by weight of aluminum, 0.5 to 3% by weight of silicon, 0.5 to 1% by weight of yttrium and 3 to 15% by weight of cobalt, the rest consisting of nickel. The above amounts are in relation to the total weight of the alloy. An alloy modified with tantalum, which especially improves the adhesion of the automatically forming aluminum oxide layer, preferably contains 18 to 25% by weight of chromium, 7 to 12% by weight of aluminum, 0.5 to 3% by weight of silicon, 0.5 to 1% by weight of yttrium, 1% by weight of tantalum, 3 to 15% by weight of cobalt. The rest of the alloy consists of nickel. This alloy also permits the addition of titanium in the amount of between 0.1 to 2% by weight of titanium, should this addition be required. An alloy for the formation of the high temperature protective coating omitting the yttrium, if required, contains preferably 18 to 27% by weight of chromium, 8 to 12% by weight of aluminum, 0.5 to 3% by weight of silicon, 1% by weight of zirconium, 5 to 20% by weight of cobalt and an amount of nickel forming the remainder of the alloy. All weights in the above alloy compositions are in relation to the respective total weights of the alloys.

A high temperature protective coating made from such an alloy has a matrix rich in chromium and poorer in aluminum with a high volume portion of a phase rich in aluminum as well as further precipitations containing large portions of zirconium and silicon.

All alloys here described are suitable for forming a high temperature protective coating. Regardless of the alloy described above by which they are formed, in every case an aluminum oxide covering layer will be formed on these protective coatings under operational conditions which is not stripped off even at temperatures in excess of 900° C.

The invention is further described by means of an exemplary embodiment describing the production of a coated structural element of a gas turbine. It is assumed that the structural element of the gas turbine to be coated has been manufactured from an austenitic material, especially a nickel super alloy. Before coating, the structural element is first chemically cleaned and then roughened with a sand blast. Coating takes place in a vacuum by use of the plasma spray method. For coating, an alloy having 18 to 25% by weight of chromium, 7 to 12% by weight of aluminum, 0.5 to 3% by weight of silicon, 0.5 to 1% by weight of yttrium and 3 to 15% by weight of cobalt is used. The remainder of the alloy consists of nickel.

In place of this alloy another alloy can be used having 18 to 27% by weight of chromium, 8 to 12% by weight of aluminum, 0.5 to 3% by weight of silicon, 1% by weight of zirconium and 5 to 20% by weight of cobalt, the remainder of the alloy being nickel.

An alloy can also be applied by means of the plasma spray method having 18 to 25% by weight of chromium, 7 to 12% by weight of aluminum, 0.5 to 3% by weight of silicon, 0.5 to 1% by weight of yttrium, 1% by weight of tantalum and 3 to 15% by weight of cobalt, while the remainder of the alloy consists of nickel. The material forming the alloy is in powder form and preferably has a grain size of 45 μm. Before applying the high temperature protective coating, in particular before applying the alloy forming the protective coating, the structural element is heated to 800° C. by means of the plasma. The alloy is applied directly to the basic material of the structural element. Argon and hydrogen are used as plasma gas. After application of the alloy the structural element is subjected to heat treatment. This is done in a high vacuum annealing furnace. A pressure of less than $\equiv\times 10^{-3}$ Torr is maintained therein. After reaching vacuum, the furnace is heated to a temperature of 1,100° C. The above temperature is maintained for about an hour within a range of approximately +/−4° C. Then the heater of the furnace is turned off. The coated and heat-treated structural element is slowly cooled inside the furnace. Manufacture is completed with the cooling.

The foregoing is a description corresponding, in substance, to German application P 36 12 568.7, dated April 15, 1986, International priority of which is being claimed for the instant application, and which is hereby made part of this application. Any material discrepancies between the foregoing specification and the specification of the aforementioned corresponding German application are to be resolved in favor of the latter.

There is claimed:

1. A high temperature protective coating made from an alloy consisting essentially of nickel, cobalt, chromium and aluminum especially for structural elements of an austenitic material, the alloy containing 18 to 27% by weight of chromium, 8 to 12% by weight of aluminum, 0.5 to 3% by weight of silicon, 1% weight of zirconium and 5 to 20% by weight of cobalt in relation to the total weight of the alloy, and the remainder of the alloy is nickel.

2. A high temperature protective coating made from an alloy consisting essentially of nickel, cobalt, chromium and aluminum especially for structural elements of an austenitic material, the alloy containing:

18.0 to 27.0% by weight of chromium;
7.0 to 12.0% by weight of aluminum;
0.5 to 3.0% by weight of silicon;
0.5 to 1.0% by weight of yttrium;
0.5 to 3.0% by weight of tantalum;
0.5 to 20% by weight of cobalt in relation to the total weight of the alloy, and the remainder of the alloy being nickel.

3. Coating according to claim 2, wherein the alloy additionally contains 0.1 to 2.0% by weight of titanium in relation to the total weight of the alloy.

4. Coating according to claim 2, wherein the content of tantalum is 1.0% by weight of the alloy.

* * * * *

UNITED STATES PATENT AND TRADEMARK OFFICE

CERTIFICATE OF CORRECTION

PATENT NO. : 4,909,984

DATED : March 20, 1990

INVENTOR(S) : Singheiser et al

It is certified that error appears in the above-identified patent and that said Letters Patent is hereby corrected as shown below:

In the title page, in the line under [57] ABSTRACT,
"4 Claims, 5 Drawing Sheets" should read
--4 Claims, No Drawing Sheets--.

Figure 2:
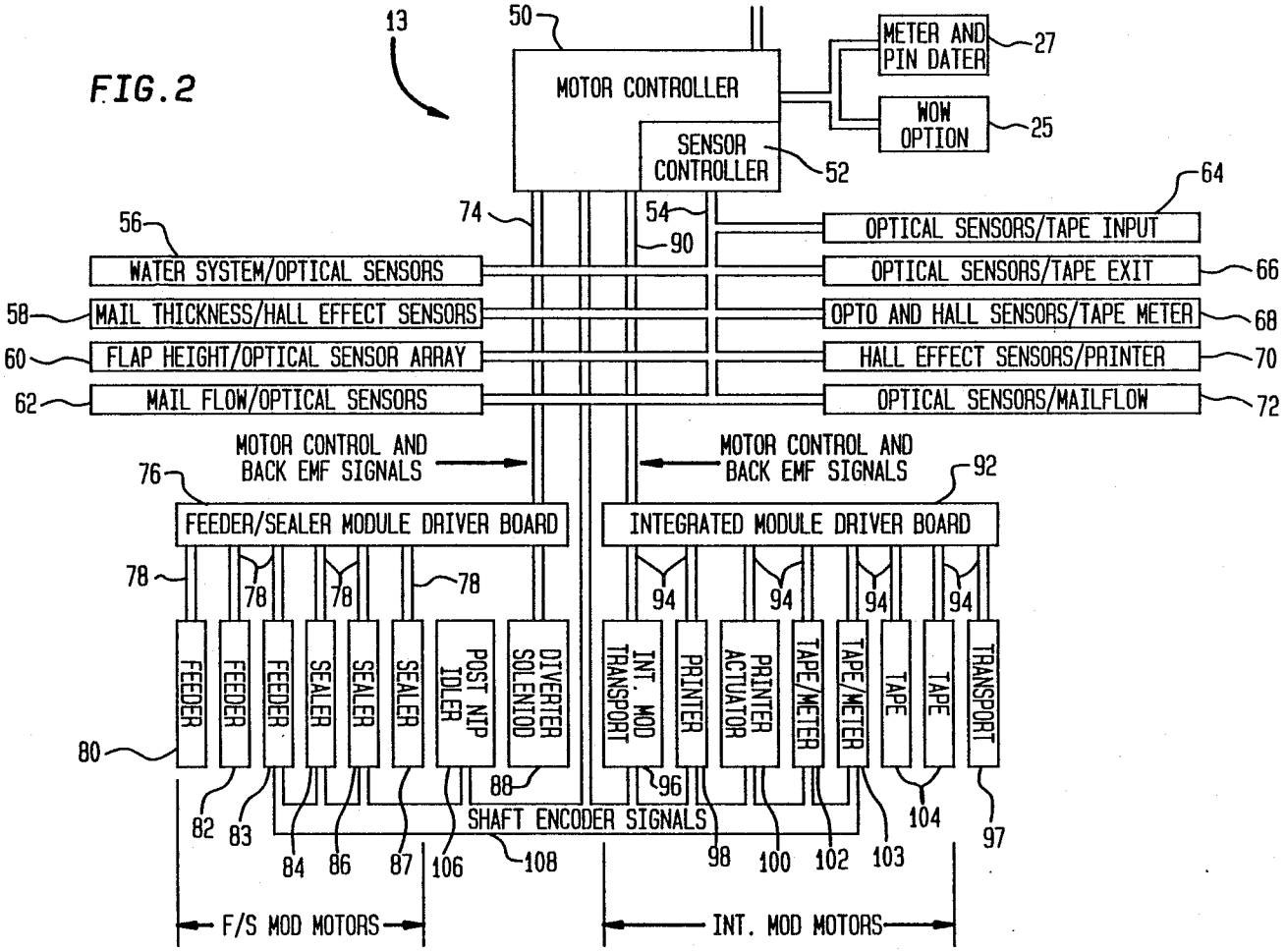
Figure 3:
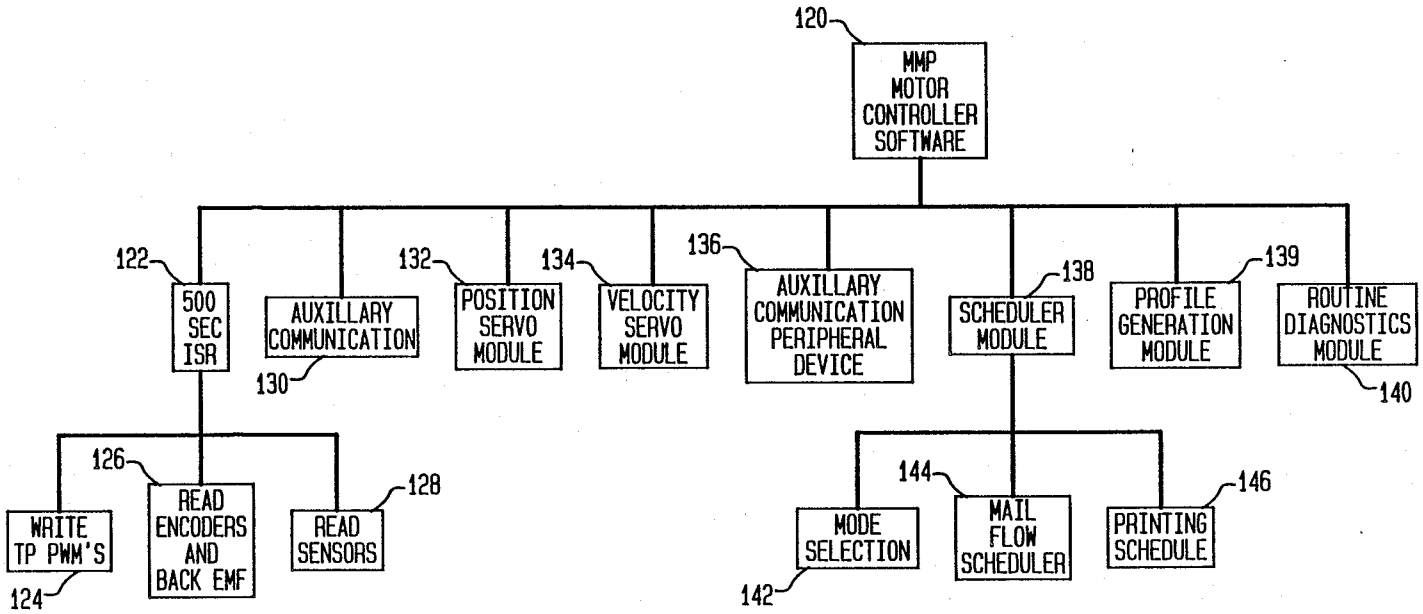
Figure 4:
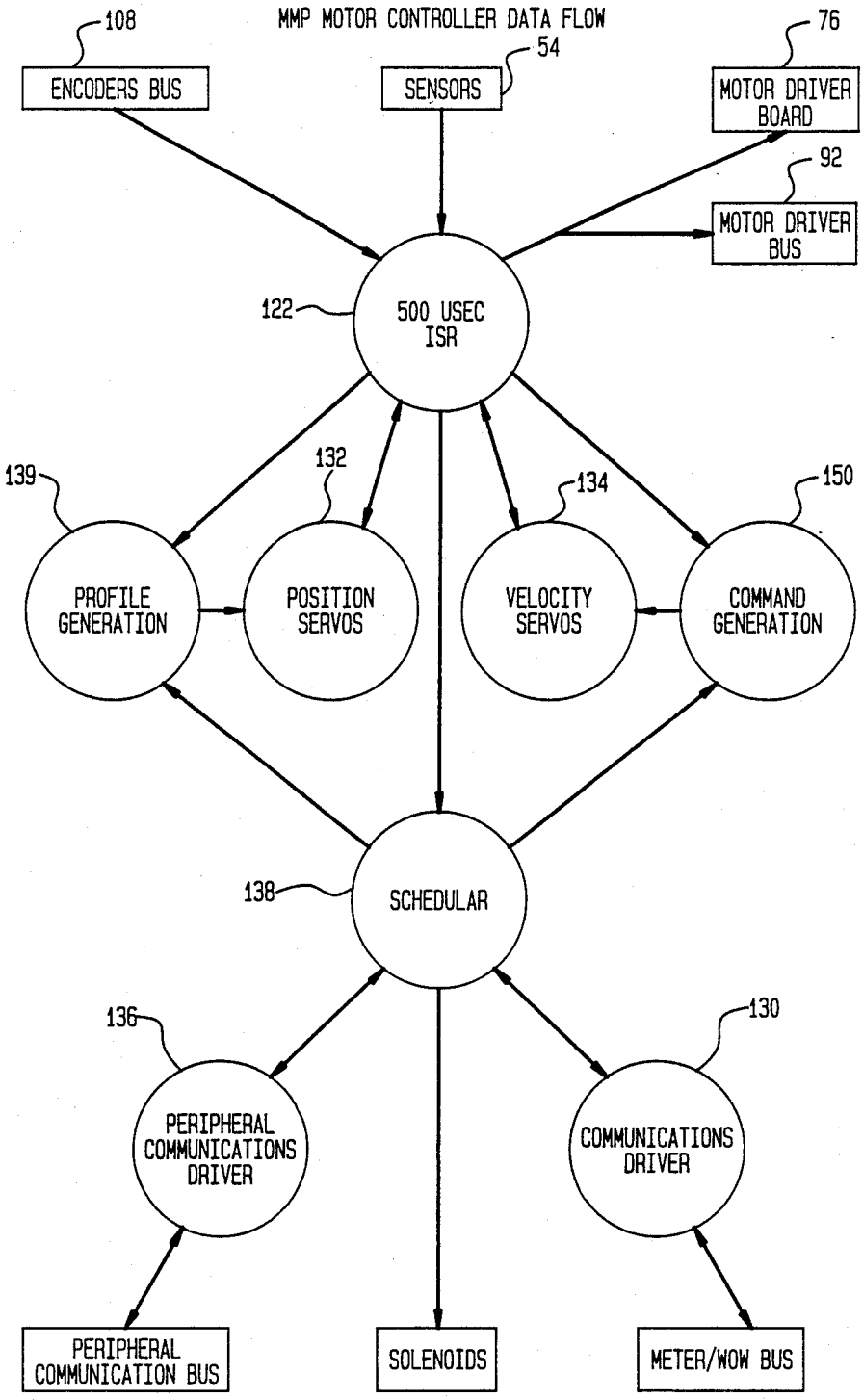
Figure 5:
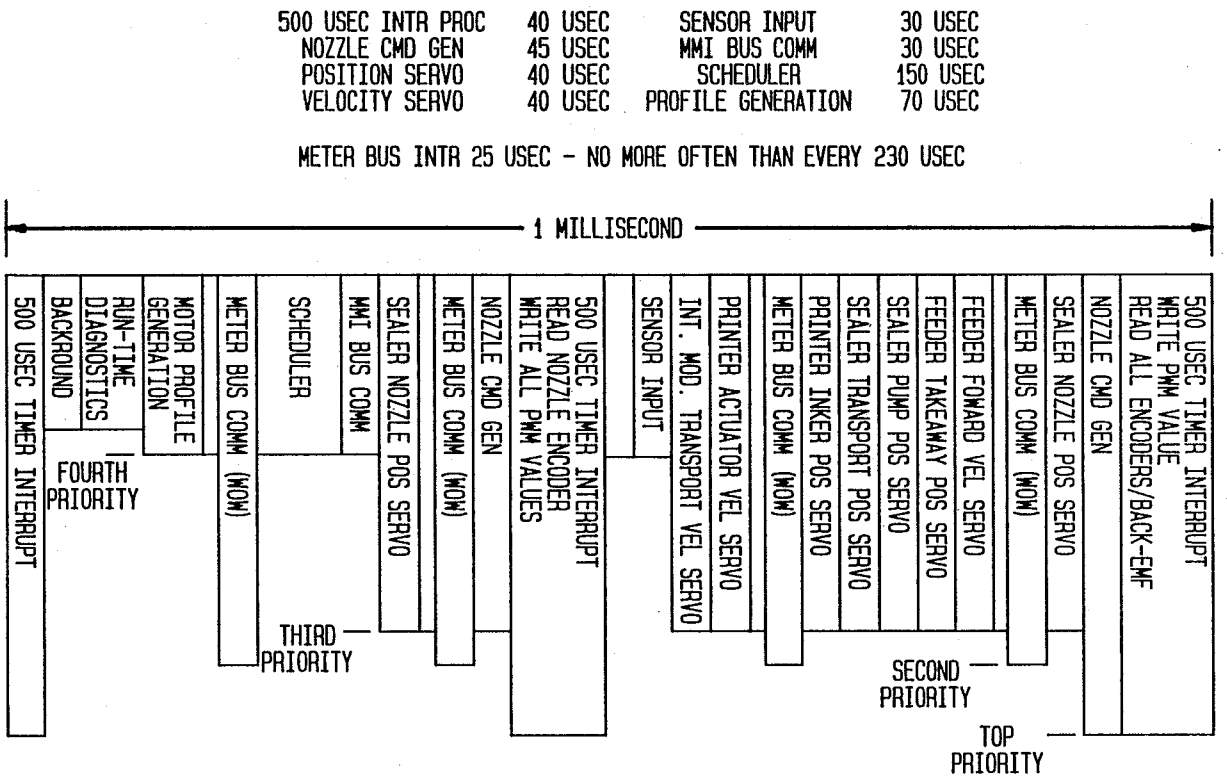

The five sheets of drawings, conssiting of Figs. 1-5, should be deleted.

Signed and Sealed this

Seventeenth Day of November, 1992

*Attest:*

DOUGLAS B. COMER

*Attesting Officer*

*Acting Commissioner of Patents and Trademarks*